US011192135B2

(12) United States Patent
Ritchie

(10) Patent No.: US 11,192,135 B2
(45) Date of Patent: Dec. 7, 2021

(54) DEVICE TO FACILITATE PAINTING OF MOLDING

(71) Applicant: Brent Ritchie, Winchester, KY (US)

(72) Inventor: Brent Ritchie, Winchester, KY (US)

( * ) Notice: Subject to any disclaimer, the term of this patent is extended or adjusted under 35 U.S.C. 154(b) by 0 days.

(21) Appl. No.: 16/273,432

(22) Filed: Feb. 12, 2019

(65) Prior Publication Data

US 2019/0255557 A1 Aug. 22, 2019

Related U.S. Application Data

(60) Provisional application No. 62/633,093, filed on Feb. 21, 2018.

(51) Int. Cl.

| | |
|---|---|
| ***B05C 13/02*** | (2006.01) |
| ***B05B 13/02*** | (2006.01) |
| *E04F 19/04* | (2006.01) |
| *B25B 11/00* | (2006.01) |
| *F26B 25/18* | (2006.01) |

(52) U.S. Cl.

CPC ..... *B05C 13/02* (2013.01); *B05B 13/0207* (2013.01); *B05B 13/0285* (2013.01); *B25B 11/00* (2013.01); *E04F 19/04* (2013.01); *E04F 2019/0454* (2013.01); *F26B 25/18* (2013.01)

(58) Field of Classification Search

CPC ..... B05B 13/0285

See application file for complete search history.

(56) References Cited

U.S. PATENT DOCUMENTS

| | | | | | |
|---|---|---|---|---|---|
| 1,963,242 | A * | 6/1934 | Nelson | C23D 5/00 | 192/13 A |
| 2,252,963 | A * | 8/1941 | Fahrenwald | C23D 9/00 | 198/692 |
| 3,899,805 | A * | 8/1975 | McMillan | E04C 2/32 | 428/141 |
| 4,197,669 | A * | 4/1980 | Hynes | A63H 33/084 | 52/608 |
| 4,269,008 | A * | 5/1981 | Assouline | E04D 13/004 | 52/101 |
| 4,354,288 | A * | 10/1982 | Dennis | A47C 19/021 | 108/56.1 |
| 4,824,063 | A * | 4/1989 | Miller | F26B 25/18 | 248/346.01 |
| 5,181,686 | A * | 1/1993 | Barthel | F26B 25/18 | 248/173 |
| 2009/0283035 | A1* | 11/2009 | Bucci | B05B 13/02 | 118/500 |
| 2011/0309540 | A1* | 12/2011 | Dittmann | F27D 5/0043 | 264/16 |
| 2014/0142614 | A1* | 5/2014 | Gallagher | A61H 7/001 | 606/201 |

* cited by examiner

*Primary Examiner* — Binu Thomas

(74) *Attorney, Agent, or Firm* — The Iwashko Law Firm, PLLC; Lev Ivan Gabriel Iwashko

(57) ABSTRACT

A device to facilitate painting of a molding, the device including a base having a bottom surface to contact an external surface, and a plurality of pyramid portions to extend away from a top surface of the base, such that the plurality of pyramid portions are linearly disposed along the base to form a plurality of notches between adjacent pyramid portions.

4 Claims, 1 Drawing Sheet

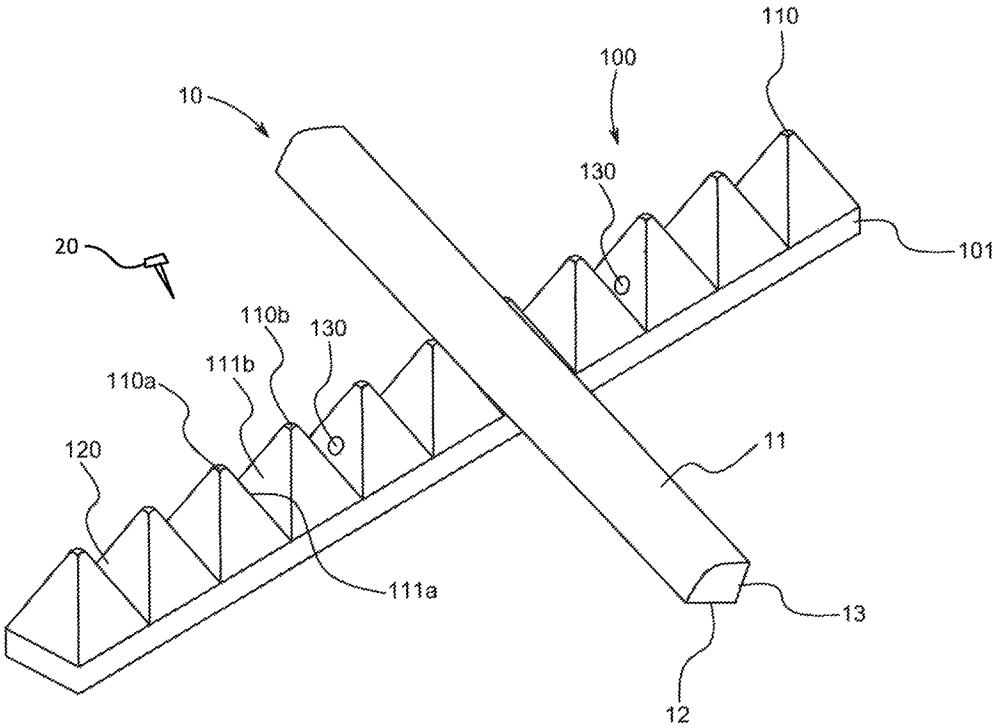
10
20
100
110
101
130
11
12
13
110a
111b
110b
130
111a
120

DEVICE TO FACILITATE PAINTING OF MOLDING

CROSS REFERENCE TO RELATED APPLICATION

This application claims benefit from, and therefore, incorporates by reference, U.S. provisional patent application Ser. No. 62/633,093, entitled "Device to Facilitate Painting of Molding," which was filed on Feb. 21, 2018.

BACKGROUND

1. Field

The present general inventive concept relates generally to a device to facilitate painting of molding.

2. Description of the Related Art

For any type of flooring or home improvement project, something that can really tie a room together is baseboard trimming; however, painting trim such as quarter round can be a difficult, time-consuming task due to its angular nature.

In detail, since the trim is typically cone-shaped, the trim cannot stand upright on its own, which leaves the painter with only the option to lay it on one side and wait a day for the other two sides to dry in order to flip it over and paint what's unpainted, risking having the trim stick to the surface that it's being painted on, potentially causing damage to floors, tables, or the trim itself. Moreover, this type of piecemeal painting is not efficient, and takes more time than necessary.

Therefore, there is a need for a device that helps a painter to easily paint and dry molding without spilling paint on external surfaces.

SUMMARY

The present general inventive concept provides a device to facilitate painting of molding.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a device to facilitate painting of a molding, the device including a base having a bottom surface to contact an external surface, and a plurality of pyramid portions to extend away from a top surface of the base, such that the plurality of pyramid portions are linearly disposed along the base to form a plurality of notches between adjacent pyramid portions.

At least one of the plurality of notches may receive at least a portion of the molding therein.

The plurality of notches may each be formed by two adjacent beveled walls of two adjacent pyramid portions.

The device may further include at least one securing hole disposed on at least a portion of at least one of the plurality of pyramid portions to receive a securing device therein to secure the device to the external surface.

The foregoing and/or other features and utilities of the present general inventive concept may be achieved by providing a device to facilitate painting of a molding having a first flat surface, a second flat surface, and a rounded surface, the device including a base having a bottom surface to contact an external surface, a first pyramid portion to extend away from a top surface of the base, the first pyramid portion including a first beveled edge to contact the first flat surface of the molding, and a second pyramid portion to extend away from the top surface of the base, the second pyramid portion including a second beveled edge adjacent to the first beveled edge to contact the second flat surface of the molding.

The device may further include at least one securing hole disposed on at least one of the first beveled edge and the second beveled edge to receive a securing device therein to secure the device to the external surface.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a device to facilitate painting of molding, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

FIG. 1 illustrates a device 100 to facilitate painting of molding 10, according to an exemplary embodiment of the present general inventive concept.

Referring to FIG. 1 the device 100 may include a base 101, a plurality of pyramid portions 110, a plurality of notches 120, and a plurality securing holes 130.

The device 100 may be constructed from wood, metal, rubber, plastic, or any other material known to one of ordinary skill in the art.

The base 101 may have a flat surface on a bottom portion thereof, which may allow the device 100 to sit flat upon any surface.

The plurality of pyramid portions 110 may be disposed on a top surface of the base 101. More specifically, the plurality of pyramid portions 110 may extend perpendicularly away from the top surface of the base 101.

The plurality of pyramid portions 110 may each have similar pyramidal shapes including four surfaces beveled away from the top surface of the base 101 to form a point.

The plurality of pyramid portions 110 may be disposed to be equidistant from each other in a horizontal direction (i.e., in a direction parallel to the base 101), such that they each form the plurality of notches 120 therebetween.

One or more of the plurality of notches 120 may include the plurality of securing holes 130 to allow a user to optionally secure the device 100 to an external surface using a securing device 20.

In other words, the plurality of notches 120 are each formed by two adjacent beveled walls of two adjacent pyramid portions 110.

The molding 10 illustrated in FIG. 1 is depicted as a quarter-molding, but is not limited thereto.

The molding 10 may include a rounded surface 11, a first flat surface 12, and a second flat surface 13.

The rounded surface 11 is typically a surface that a painter paints.

In order to paint the rounded surface 11 of the molding 10 without damaging external surfaces, the molding 10 may be inserted within one of the plurality of notches 120 such that the first flat surface 12 of the molding 10 contacts a beveled wall 111*a* of a first pyramid portion 110*a*, and the second flat surface 13 of the molding 10 contacts another beveled wall 111*b* of a second pyramid portion 110*b*.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A device to facilitate painting of a molding, the device comprising:

a base having a bottom surface to contact an external surface;

a plurality of pyramid portions to extend away from a top surface of the base, such that the plurality of pyramid portions are linearly disposed along the base to form a plurality of notches between adjacent pyramid portions, such that each of the plurality of pyramid portions shares at least one linear-shaped edge with at least one of the plurality of pyramid portions; and at least one securing hole to receive a securing device therein to secure the device to the external surface, such that the at least one securing hole is disposed on at least a portion of a face of a beveled wall of at least one of the plurality of pyramid portions, and such that the securing hole is disposed to be distanced away from a top most point of the at least one of the plurality of pyramid portions, such that the top most point of the at least one of the plurality of pyramid portions comprises a portion of the at least one of the plurality of pyramid portions that is disposed furthest away from the top surface of the base.

2. The device of claim 1, wherein at least one of the plurality of notches receives at least a portion of the molding therein.

3. The device of claim 1, wherein the plurality of notches are each formed by two adjacent beveled walls of two adjacent pyramid portions.

4. A device to facilitate painting of a molding having a first flat surface, a second flat surface, and a rounded surface, the device comprising:

a base having a bottom surface to contact an external surface;

a first pyramid portion to extend away from a top surface of the base, the first pyramid portion including a first beveled edge to contact the first flat surface of the molding;

a second pyramid portion to extend away from the top surface of the base, the second pyramid portion including a second beveled edge adjacent to the first beveled edge to contact the second flat surface of the molding, such that the first pyramid portion shares a linear-shaped edge with the second pyramid portion; and at least one securing hole disposed on a surface of the first beveled edge to receive a securing device therein to secure the device to the external surface, such that the at least one securing hole is distanced away from a top most point of the first pyramid portion, such that the top most point of the first pyramid portion comprises a portion of the first pyramid portion that is disposed furthest away from the top surface of the base.

* * * * *